US006222132B1

(12) United States Patent
Higashiura et al.

(10) Patent No.: US 6,222,132 B1
(45) Date of Patent: Apr. 24, 2001

(54) MULTILAYER INSULATED WIRE AND TRANSFORMERS USING THE SAME

(75) Inventors: Atsushi Higashiura; Isamu Kobayashi, both of Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 09/331,663

(22) PCT Filed: Oct. 21, 1998

(86) PCT No.: PCT/JP98/04770

§ 371 Date: Jun. 23, 1999

§ 102(e) Date: Jun. 23, 1999

(87) PCT Pub. No.: WO99/22381

PCT Pub. Date: May 6, 1999

(30) Foreign Application Priority Data

Oct. 24, 1997 (JP) ..... 9-292928

(51) Int. Cl.[7] ..... H01B 3/00
(52) U.S. Cl. ..... 174/120 R
(58) Field of Search ..... 174/120 R, 120 SR, 174/110 SR, 110 PM, 120 AR, 127

(56) References Cited

U.S. PATENT DOCUMENTS

| | | | | |
|---|---|---|---|---|
| 5,606,152 | | 2/1997 | Higashiura et al. | 174/120 R |
| 5,654,095 | * | 8/1997 | Yin et al. | 174/120 R X |

FOREIGN PATENT DOCUMENTS

| | | |
|---|---|---|
| 49-76278 | 10/1947 | (JP) . |
| 52-142760 | 11/1977 | (JP) . |
| 57-2361 | 1/1982 | (JP) . |
| 3-56112 | 5/1991 | (JP) . |
| 3134915 | 6/1991 | (JP) . |
| 410305 | 4/1992 | (JP) . |
| 657145 | 3/1994 | (JP) . |
| 6139827 | 5/1994 | (JP) . |
| 6139828 | 5/1994 | (JP) . |
| 6139829 | 5/1994 | (JP) . |
| 973818 | 3/1997 | (JP) . |

OTHER PUBLICATIONS

Microfilm of the specification and drawings annexed to the request of Japanese Utility Model Application No. 121302/1972 (Laid–open No. 76278/1974), (Showa Electric Wire & Cable Co., Ltd.), Jul. 2, 1974, p. 3, line 3 to p. 4, line 11.

* cited by examiner

*Primary Examiner*—Kristine Kincaid
*Assistant Examiner*—Chau N. Nguyen
(74) *Attorney, Agent, or Firm*—Birch, Stewart, Kolasch & Birch, LLP

(57) ABSTRACT

A multilayer insulated wire has a conductor and solderable extrusion-insulating layer made up of two or more layers for covering the conductor. At least one insulating layer including the outermost layer is formed by a mixture of 100 parts by weight of resin components in which 100 parts by weight of a thermoplastic polyester-series resin (A) is blended with 5 to 40 parts by weight of an ethylene-series copolymer having a carboxylic acid component or a metal salt of the carboxylic acid component in its side chain, and 10 to 80 parts by weight of an inorganic filler (B). A transformer which utilizes the multilayer insulated wire has excellent solderability, high-frequency characteristics, peel resistance under high-voltage and high-frequency, and coilability, and it is favorably suitable for industrial production. A transformer utilizing the multilayer insulated wire has excellent electrical properties and high reliability, because when used at high frequencies, there arises no problem of lowering of electric properties and scraping-off from the wire by corona.

16 Claims, 2 Drawing Sheets

PRIOR ART

MULTILAYER INSULATED WIRE AND TRANSFORMERS USING THE SAME

This application is the national phase under 35 U.S.C. §371 of PCT International Application No. PCT/JP98/04770 which has an International filing date of Oct. 21, 1998 which designated the United States of America.

TECHNICAL FIELD

The present invention relates to a multilayer insulated wire whose insulating layers are composed of two or more extrusion-coating layers. The present invention also relates to a transformer in which the said multilayer insulated wire is utilized. More specifically, the present invention relates to a multilayer insulated wire that is useful as a winding and a lead wire of a transformer incorporated, for example, in electrical/electronic equipment; the said wire is excellent in high-frequency characteristic, and it has such excellent solderability that, when the said wire is dipped in a solder bath, the insulating layer can be removed in a short period of time, to allow the solder to adhere easily to the conductor. The present invention also relates to a transformer that utilizes said multilayer insulated wire.

BACKGROUND ART

The structure of a transformer is prescribed by IEC (International Electrotechnical Communication) Standards Pub. 950, etc. That is, these standards provide that at least three insulating layers be formed between primary and secondary windings in a winding, in which an enamel film which covers a conductor of a winding be not authorized as an insulating layer, or that the thickness of an insulating layer be 0.4 mm or more. The standards also provide that the creeping distance between the primary and secondary windings, which varies depending on the applied voltage, be 5 mm or more, that the transformer withstand a voltage of 3,000 V applied between the primary and secondary sides for a minute or more, and the like.

According to such the standards, as a currently prevailing transformer has a structure such as the one illustrated in a cross-section of FIG. 2. In the structure, an enameled primary winding 4 is wound around a bobbin 2 on a ferrite core 1 in a manner such that insulating barriers 3 for securing the creeping distance are arranged individually on the opposite sides of the peripheral surface of the bobbin. An insulating tape 5 is wound for at least three turns on the primary winding 4, additional insulating barriers 3 for securing the creeping distance are arranged on the insulating tape, and an enameled secondary winding 6 is then wound around the insulating tape.

Recently, a transformer having a structure which includes neither the insulating barriers 3 nor the insulating tape layer 5, as shown in FIG. 1, has started to be used in place of the transformer having the structure shown in the cross-section of FIG. 2. The transformer shown in FIG. 1 has an advantage over the one having the structure shown in FIG. 2 in being able to be reduced in overall size and dispense with the winding operation for the insulating tape.

In manufacturing the transformer shown in FIG. 1, it is necessary, in consideration of the aforesaid IEC standards, that at least three insulating layers 4*b* (6*b*), 4*c* (6*c*), and 4*d* (6*d*) are formed on the outer peripheral surface on one or both of conductors 4*a* (6*a*) of the primary winding 4 and the secondary winding 6 used.

As such a winding, a winding in which an insulating tape is first wound around a conductor to form a first insulating layer thereon, and is further wound to form second and third insulating layers in succession, so as to form three insulating layers that are separable from one another, is known. Further, a winding in which a conductor enameled with polyurethane is successively extrusion-coated with a fluororesin, whereby extrusion-coating layers composed of three layers structure in all are formed for use as insulating layers, is known (JU-A-3-56112 ("JU-A" means unexamined published Japanese Utility Model application).

In the above-mentioned case of winding an insulating tape, however, because winding the tape is an unavoidable operation, the efficiency of production is extremely low, and thus the cost of the electrical wire is conspicuously increased.

In the above-mentioned case of extrusion of a fluororesin, since the insulating layer is made of the fluororesin, there is the advantage of good heat resistance and high-frequency characteristic. On the other hand, because of the high cost of the resin and the property that when it is pulled at a high shearing speed, the state of the external appearance is deteriorated, it is difficult to increase the production speed, and like the insulating tape, the cost of the electric wire becomes high. Further, in this case of the insulating layer, there is a problem that, since the insulating layer cannot be removed by dipping in a solder bath, the insulating layer on the terminal has to be removed using less reliable mechanical means, and further the wire must be soldered or solderless-connected, when the terminal is worked for the insulated wire to be connected, for example, to a terminal.

On the other hand, a multilayer insulated wire is put to practical use, wherein multilayer extrusion-insulating layers are formed from a mixture of a polyethylene terephthalate as a base resin with an ionomer prepared by converting part of carboxyl groups of an ethylene/methacrylic acid copolymer to metal salts, and wherein the uppermost covering layer among the insulating layers is made of a polyamide (nylon). This multilayer insulated wire is excellent in cost of electrical wire (nonexpensive materials and high producibility), solderability (to make possible direct connection between an insulated wire and a terminal), and coilability (that means that, in winding the insulated wire around a bobbin, the insulating layer is not broken to damage the electrical properties of the coil, when, for example, parts of the insulated wire are rubbed with each other or the insulated wire is rubbed with a guide nozzle) (U.S. Pat. No. 5,606,152, and JP-A-6-223634 ("JP-A" means unexamined published Japanese patent application)).

Further, to improve heat resistance, the inventors proposed an insulated wire whose base resin is changed from the above polyethylene terephthalate to polycyclohexanedimethylene terephthalate (PCT).

The heat resistance of these multilayer insulated wires is acceptable to heat-resistance Class E in the test method in conformity to Annex U (Insulated wires) of Item 2.9.4.4 and Annex C (Transformers) of Item 1.5.3 of the IEC 950-standards, and there is no problem on the heat resistance. However, in recent years, the frequency used in transformers in circuits is made into higher frequencies, and in order to meet the higher required level from now on, a further improvement in electrical properties at higher frequencies is demanded.

Further, in a multilayer insulated wire having a self-bonding layer on an extrusion-coating insulating layer, the self-bonding layer is sometimes scraped from the adhered parts in the vicinity between wires by corona under high voltage and high frequencies, and therefore an improvement in physical properties under high voltage and high frequencies is desired similarly to the above.

To solve such problems, an object of the present invention is to provide a multilayer insulated wire that is excellent in solderability, high-frequency characteristic, prevention of scraping-off of an insulating-coating under high-voltage and high-frequency, and coilability, and that is favorably suitable for industrial production.

Further, another object of the present invention is to provide a transformer having excellent electrical properties and high reliability, wherein, when it is used at high frequencies, such problems as lowering of the electric properties, scraping of a wire by corona, and the like, do not occur, and wherein such an insulated wire excellent in solderability, high-frequency characteristic, and coilability is wound.

Other and further objects, features, and advantages of the invention will appear more fully from the following description, taken in connection with the accompanying drawings.

DISCLOSURE OF INVENTION

The above objects of the present invention have been attained by the following multilayer insulated wire and the following transformer in which the said wire is used.

That is, according to the present invention there is provided:

(1) A multilayer insulated wire comprising a conductor and solderable extrusion-insulating layers made up of two or more layers for covering the conductor, wherein at least one insulating layer including the outermost layer is made of a mixture comprising 100 parts by weight of resin components in which 100 parts by weight of a thermoplastic polyester-series resin (A) is blended with 5 to 40 parts by weight of an ethylene-series copolymer having a carboxylic acid component or a metal salt of the carboxylic acid component in its side chain, and 10 to 80 parts by weight of an inorganic filler (B), (2) The multilayer insulated wire as stated in the above (1), wherein the remaining layers other than the at least one insulating layer including the outermost layer each were made of the thermoplastic polyester-series resin (A) or a mixture in which 100 parts by weight of the resin is blended with 5 to 40 parts by weight of the ethylene-series copolymer having a carboxylic acid component or a metal salt of the carboxylic acid component in its side chain, (3) The multilayer insulated wire as stated in the above (1) or (2), wherein the at least one insulating layer including the outermost layer is made of the mixture in which 20 to 60 parts by weight of the inorganic filler (B) is blended, (4) The multilayer insulated wire as stated in one of the above (1) to (3), wherein the thermoplastic polyester-series resin (A) comprises at least one selected from the group consisting of polyethylene terephthalate resins, polybutylene naphthalate resins, polycyclohexanedimethylene terephthalate resins, and polyethylene naphthalate resins, (5) The multilayer insulated wire as stated in one of the above (1) to (4), wherein the inorganic filler (B) comprises at least one selected from among titanium oxide and silica, (6) The multilayer insulated wire as stated in one of the above (1) to (5), wherein the inorganic filler (B) has an average particle diameter of 5 $\mu$m or less, (7) The multilayer insulated wire as stated in one of the above (1) to (6), wherein a self-bonding resin (C) is extruded onto the outside of the covering insulating layers, to form a self-bonding layer, (8) The multilayer insulated wire as stated in the above (7), wherein the self-bonding resin (C) is a copolymerized polyester resin or a copolymerized polyamide resin, (9) The multilayer insulated wire as stated in the above (7) or (8), wherein the self-bonding layer is one formed by extruding a mixture made by mixing 100 parts by weight of the self-bonding resin (C) with 10 to 70 parts by weight of an inorganic filler (D),

(10) A multilayer insulated wire comprising a conductor and solderable extrusion-insulating layers made up of two or more layers for covering the conductor, wherein at least one insulating layer including the outermost layer is made of a mixture in which 100 parts by weight of a thermoplastic polyester-series resin (A) is blended with 5 to 40 parts by weight of an ethylene-series copolymer having a carboxylic acid component or a metal salt of the carboxylic acid component in its side chain, and a resin made by mixing 100 parts by weight of a self-bonding resin (C) with 10 to 70 parts by weight of an inorganic filler (D), is extruded onto the outside of the covering insulating layers, to form a self-bonding layer,

(11) The multilayer insulated wire as stated in the above (10), wherein the thermoplastic polyester-series resin (A) comprises at least one selected from the group consisting of polyethylene terephthalate resins, polybutylene naphthalate resins, polycyclohexanedimethylene terephthalate resins, and polyethylene naphthalate resins,

(12) The multilayer insulated wire as stated in the above (10) or (11), wherein the self-bonding resin (C) is a copolymerized polyester resin or a copolymerized polyamide resin,

(13) The multilayer insulated wire as stated in one of the above (10) to (12), wherein the inorganic filler (D) comprises at least one selected from among titanium oxide and silica,

(14) The multilayer insulated wire as stated in one of the above (10) to (13), wherein the inorganic filler (D) has an average particle diameter of 5 $\mu$m or less,

(15) A multilayer insulated wire, comprising the multilayer insulated wire in one of the above (1) to (14) whose outer surface is coated with a paraffin and/or a wax,

(16) A method of producing the multilayer insulated wire claimed in one of the above (1) to (9), comprising forming an insulating layer as at least one layer including the outermost layer of insulating layers by extrusion-coating of a mixture made by mixing a thermoplastic polyester-series resin (A), an ethylene-series copolymer having a carboxylic acid component or a metal salt of the carboxylic acid component on its side chain, and an inorganic filler (B), wherein the thermoplastic polyester-series resin (A), the ethylene-series copolymer, and the inorganic filler (B) are kneaded into a mixture after the water content of each of the thermoplastic polyester-series resin (A), the ethylene-series copolymer, and the inorganic filler (B) being brought to 0.02% by weight or less, and the resulting mixture is extruded onto the outside of a conductor to form the insulating layer with the water content of the resulting mixture being 0.02% by weight or less, and

(17) A transformer, wherein the multilayer insulated wire in one of the above (1) to (15) is utilized.

Herein, the outermost layer in the present invention refers to the layer situated farthest from the conductor out of the extrusion-coating insulating layers.

BEST MODE FOR CARRYING OUT THE INVENTION

Figure 1:
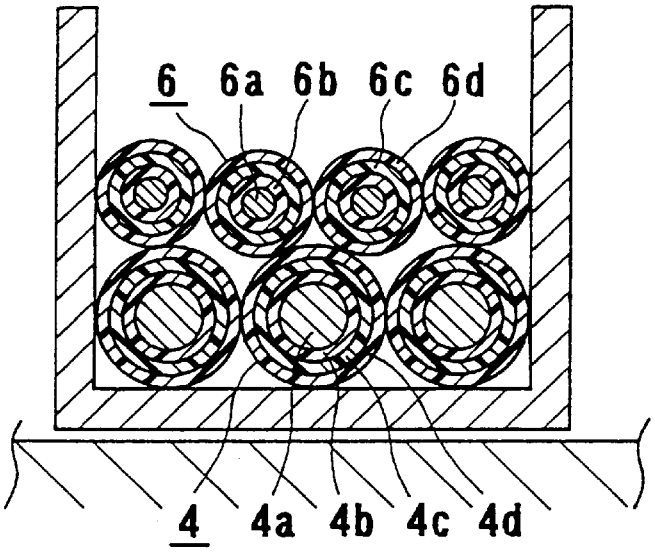
FIG. 1 is a cross-sectional view illustrating an example of the transformer having a structure in which three-layer insulated wires are used as windings.
Figure 2:
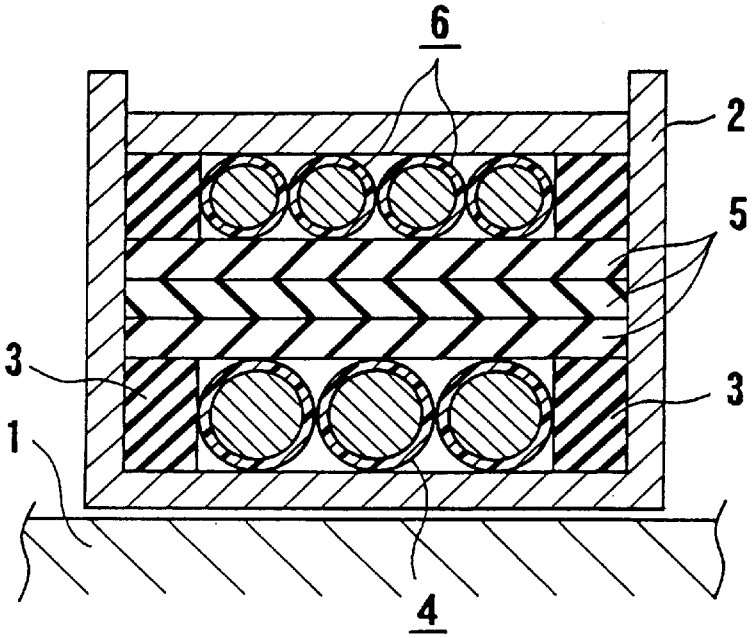
FIG. 2 is a cross-sectional view illustrating an example of the transformer having a conventional structure.

Among the resin components used in the present invention, the resin (A) is a thermoplastic polyester-series resin, which is selected for use from known resins good in solderability.

As the thermoplastic polyester-series resin, one obtained by the esterification reaction of an aromatic dicarboxylic acid with an aliphatic diol or an alicyclic diol can be used. Examples include polyethylene terephthalate (PET) resins, polybutylene naphthalate (PBN) resins, polycyclohexanedimethylene terephthalate (PCT) resins, and polyethylene naphthalate (PEN) resins. As commercially available resins, use can be made of polyethylene terephthalate (PET)-series resins, such as Vyron (trade name, manufactured by Toyobo Co., Ltd.), BELLPET (trade name, manufactured by Kanebo, Ltd.), and TEIJIN PET (trade name, manufactured by Teijin Ltd.); polybuthylene naphthalate (PBN)-series resins, such as TEIJIN PBN (trade name, manufactured by Teijin Ltd.); polyethylene naphthalate (PEN)-series resins, TEIJIN PEN (trade name, manufactured by Teijin Ltd.); and polycyclohexanedimethylene terephthalate (PCT)-series resins, such as EKTAR (trade name, manufactured by Toray Industries, Inc.).

Further, the thermoplastic polyester-series resin (A) may be blended with an ethylene-series copolymer, having a carboxylic acid component or a metal salt of the carboxylic acid component on its side chain, that acts to suppress the crystallization of the resin. Particularly, with the resin used in the outermost layer of the multilayer insulating layers, this ethylene-series copolymer is blended. This ethylene-series copolymer can suppress the deterioration with lapse of time of the electrical properties of the formed insulating layer. The carboxylic acid to be attached includes, for example, an unsaturated monocarboxylic acid such as acrylic acid, methacrylic acid, and crotonic acid, and an unsaturated dicarboxylic acid such as maleic acid, fumaric acid, and phthalic acid, and their metal salts include, for example, salts of Na, Zn, K, and Mg.

Such an ethylene-series copolymer include, for example, a resin, generally called an ionomer, that is formed by converting a part of carboxylic acid components of an ethylene/methacrylic acid copolymer into metal salts (e.g., HI-MILAN (trade name; manufactured by Mitsui Polychemical Co., Ltd.)), an ethylene/acrylic acid copolymer (e.g., EAA (trade name; manufactured by Dow Chemical LTD.)), and an ethylene-series graft polymer having carboxylic acid components on its side chain (e.g., ADMER (trade name; manufactured by Mitsui Petrochemical Industries Ltd.)). Preferably this ethylene-series copolymer is blended in an amount of 5 to 40 parts by weight, and more preferably 7 to 25 parts by weight, to 100 parts by weight of the above resin. If the ethylene-series copolymer is too much, not only the heat resistance of the insulating layer is conspicuously lowered but also the solderability is deteriorated in some cases. When the ethylene-series copolymer is blended, preferably the resin comprises at least one selected from the group consisting of polyethylene terephthalate (PET)-series resins, polycyclohexanedimethylene terephthalate (PCT)-series resins, and polyethylene naphthalate (PEN)-series resins.

In the present invention, in order to further improve the high-frequency characteristic of the multilayer insulated wire, a mixture including the thermoplastic polyester-series resin (A) and the inorganic filler (B) is used to form an insulating layer.

As the inorganic filler that can be used in the present invention, can be mentioned titanium oxide, silica, alumina, zirconium oxide, barium sulfate, calcium carbonate, clay, talc, and the like. Among the above, titanium oxide and silica are particularly preferable, because they are good in dispersibility in a resin, particles of them hardly aggregate, and they hardly cause voids in an insulating layer, as a result, the external appearance of the resulting insulating wire is good and abnormality of electrical properties hardly occurs. Preferably the inorganic filler has an average particle diameter of 5 $\mu$m or less, and more preferably 3 $\mu$m or less. The lower limit of the average particle diameter of the inorganic filler is not particularly restricted, and preferably it is 0.01 $\mu$m or more, and more preferably 0.1 $\mu$m or more. If the particle diameter is too large, the external appearance of the electric wire is sometimes deteriorated because of such problems as the inclusion of voids and a decrease in the smoothness of the surface. On the other hand, if the average particle diameter of the inorganic filler is too small, the bulk specific gravity becomes small and mixing (kneading) is not carried out well in some cases. Further, an inorganic filler high in water absorption property lowers the electric properties sometimes, and therefore an inorganic filler low in water absorption property is preferable. Herein, "low in water absorption property" means that the water content at room temperature (25° C.) and a relative humidity of 60% is 0.02% by weight or less.

In producing the multilayer insulated wire of the present invention, it is required to control the water content of each of the thermoplastic polyester-series resin (A), the ethylene-series copolymer, and the inorganic filler (B) that are used as raw materials of the insulating layer, to 0.02% by weight or less.

It is known that when thermoplastic polyester-series resins are subjected to melt molding, such as melt extrusion, at a high temperature with them having a high water content, hydrolysis takes place thereby making them low in molecular weight to cause the resultant molded item to loose its flexibility greatly. Therefore, generally, in molding thermoplastic polyester-series resins, a material whose water content is controlled to 0.1% by weight or less, is fed.

However, in the present invention, in addition to the resin components, an inorganic filler is required to be mixed. In that case, it has been found that the hydrolysis is further accelerated by the inorganic filler and that the flexibility of the resultant multilayer insulated wire cannot be retained unless the water content of each of the thermoplastic polyester-series resin, the ethylene-series copolymer to be blended, and the inorganic filler is controlled to 0.02% by weight or less, in order not to lower physical properties.

Accordingly, in order to bring the water content of each of the thermoplastic polyester-series resin, the ethylene-series copolymer, and the inorganic filler to 0.02% by weight or less, each of the resins and the inorganic filler that are used in the present invention is dried in a prescribed manner. Specifically, for example, the thermoplastic polyester-series resin is dried with a circulating hot air-type drier or a vacuum drier, at about 120° C. for 8 hours or more, with the resin in the form of pellets; the ethylene-series copolymer is dried with a vacuum drier, at about 60° C. for 24 hours or more, with the copolymer in the form of pellets; and the inorganic filler is dried with a hot air-type drier, at about 250° C. for 12 hours or more, so that the water content of each of them becomes 0.02% by weight or less generally.

These materials whose water content has been adjusted to 0.02% by weight or less, are charged into a hopper of a double-screw mixer (kneader), a single-screw mixer, or the like that has been flushed with nitrogen or dry air, and they are kneaded into a pelletized mixture. This mixture is again dried under the same conditions for the above thermoplastic polyester-series resin, to obtain a mixture having a water content of 0.02% by weight or less. The resulting mixture can be fed into a hopper of an extruder, to form an extrusion-coating layer on the outer periphery of a conductor under prescribed extrusion conditions, thereby obtaining the multilayer insulated wire of the present invention.

In the multilayer insulated wire produced using the materials whose water contents have been controlled in the above manner, the weight average molecular weight of the thermoplastic polyester-series resin in the insulating layer in which the organic filler is blended is 30,000 or more, which high molecular weight determines as a result whether the flexibility of the insulated wire is good or bad.

Herein, the water content referred to is a value measured with a Karl Fischer's type water content measuring apparatus described later.

The commercially available inorganic filler that can be used in the present invention includes, for example, as titanium oxide, FR-88 (trade name; manufactured by FURUKAWA CO., LTD.; average particle diameter: 0.19 μm), FR-41 (trade name; manufactured by FURUKAWA CO., LTD.; average particle diameter: 0.21 μm), and RLX-A (trade name; manufactured by FURUKAWA CO., LTD.; average particle diameter: 3 to 4 μm); as silica, UF-007 (trade name; manufactured by Tatsumori, LTD.; average particle diameter: 5 μm) and 5X(trade name; manufactured by Tatsumori, LTD.; average particle diameter: 1.5 μm); as alumina, RA-30 (trade name; manufactured by Iwatani International Corporation; average particle diameter: 0.1 μm); and as calcium carbonate, Vigot-15 (trade name; manufactured by SHIRAISHI KOGYO KAISHA, LTD.; average particle diameter: 0.15 μm) and Softon (trade name; manufactured by BIHOKU FUNKA KOGYO CO., LTD.; average particle diameter: 3 μm).

The proportion of the inorganic filler (B) in the above mixture is 10 to 80 parts by weight, to 100 parts by weight of the above thermoplastic polyester-series resin (A). If the proportion is less than 10 parts by weight, the desired high high-frequency characteristic cannot be obtained, further the heat shock resistance becomes bad, cracks reaching the conductor cannot be prevented from occurring. On the other hand, if the proportion is over 80 parts by weight, the flexibility in the function of the electric wire are conspicuously lowered, and as a result the electric properties (breakdown voltage and withstand voltage) are deteriorated. The heat shock resistance in the present invention refers to the property against heat shock due to winding stress (simulating coiling). In view of the balance among the heat resistance, the high-frequency characteristic, the heat shock resistance, and other desired electric properties, preferably the proportion of the inorganic filler (B) is 10 to 70 parts by weight, and more preferably 20 to 60 parts by weight, to 100 parts by weight of the above resin (A).

To the above mixture can be added another heat-resistant thermoplastic resin, in such amounts that they do not impair the action and effects to be attained according to the present invention. The heat-resistant thermoplastic resins that can be added are preferably ones that themselves are good in solderability, such as a polyurethane resin and a polyacrylic resin.

To the above mixture can be added additives, processing aids, and coloring agents, each of which are usually used, in such amounts that they do not impair the action and effects to be attained according to the present invention.

The insulating layers of the multilayer insulated wire of the present invention is made up of two or more layers, and preferably three layers. At least one layer out of the extruded insulating layers is an insulating layer made of the mixture containing the above thermoplastic polyester-series resin (A) and the inorganic filler (B). When an insulated wire is applied with a voltage higher than a partial discharge inception voltage by any cause, surface breakage due to corona may begin from the vicinity of parts where electric wires contact to each other, which breakage occurs more intensively under high-voltage and high-frequency, making break of wire easily proceed, thereby causing the deterioration of the electric properties. Therefore, in order to prevent this phenomenon, it is preferable that the insulating layer made of the above mixture of the thermoplastic polyester-series resin (A) and the inorganic filler (B) is positioned (provided) at least the outermost layer (and optionally another insulating layer) in the insulated wire of the present invention. Further, in view of the further improvement in the high-frequency characteristic, all the layers can be made of the above mixture, but in some cases, the electric properties (breakdown voltage and withstand voltage) are lowered a little. Therefore, preferably one layer or several layers (particularly preferably one layer or two layers) out of all the layers are made of the above mixture, or the proportion of the inorganic filler is more increased in an outer layer than in an inner layer. In this case, if only the outermost layer is made of the above mixture, the high-frequency V-t characteristic, and the heat shock resistance can be greatly improved, but one wherein the proportion of the inorganic filler is increased in the more outer layer is more preferable because the adhesion between the layers is improved.

Further, as a resin that can be used in an insulating layer other than the insulating layer made of the mixture that comprises the thermoplastic polyester-series resin (A) and the inorganic filler, thermoplastic polyester-series resins are particularly preferable, and in addition, specific polyamide resins and thermoplastic polyurethane resins can be used.

As the thermoplastic polyester-series resins, those that are mentioned and can be used as the thermoplastic polyester-resins resin (A) can be used, and similarly to the above-described thermoplastic polyester-series resin (A), they can be used with the ethylene-series copolymer blended therewith.

Further, as the polyamide resins, those produced by a known method using, as raw materials, diamines, dicarboxylic acids, etc., can be used. As commercially available resins, for example, nylon 6, 6, such as Amilan (trade name, manufactured by Toray Industries, Inc.), and MARANYL (trade name, manufactured by ICI Ltd.); nylon 4, 6, such as Unitika Nylon 46 (trade name, manufactured by Unitika Ltd.), can be mentioned.

As the thermoplastic polyurethane resins, those that can be produced by the known method using, for example, an aliphatic dialcohol and a diisocyanate, as raw materials, can be used. As commercially available resins, for example, Miractran (trade name; manufactured by Nippon Miractran Co., Ltd.) can be used.

Taking the heat resistance and the solderability into consideration, a thermoplastic polyester-series resin or a polyamide resin is preferable. Further, taking the electrical properties and the high-frequency characteristic into account, a thermoplastic polyester-series resin is preferable, and a thermoplastic polyester-series resin to which the ethylene-series copolymer is blended is more preferable.

Herein, when at least the outermost layer of the multilayer insulating layers is made of the mixture that comprises the resin components, in which the thermoplastic polyester-series resin (A) is blended with the ethylene-series copolymer, and the inorganic filler (B), the deterioration with lapse of time of the electrical properties (the lowering of the electrical properties with lapse of time) does not occur, even if a non-modified thermoplastic polyester-series resin (A) to which the ethylene-series copolymer is not blended, is used in other insulating layers.

Further, in the present invention, onto the outside of the extrusion-coating insulating layer of the multilayer insulated wire, a self-bonding resin (C) may be extruded for covering, to make a multilayer insulated wire having a self-bonding layer. In this mode of the invention, the extrusion-coating insulating layer onto which a self-bonding layer is formed, comprises a) two or more insulating layers at least having the outermost layer that is an insulating layer made of the above mixture containing the thermoplastic polyester-series resin (A) and the inorganic filler (B), or b) two or more insulating layers all of which are made of the thermoplastic polyester-series resin (A) with which the ethylene-series copolymer is blended.

Herein, the self-bonding resin (C) is preferably fixed at a low temperature or with a low-boiling solvent, because in that case the properties of the underlying insulating layer are not adversely affected; and as that resin, a copolymerized polyester resin or a copolymerized polyamide resin is preferable.

As commercially-available copolymerized polyamide resins, for example, PLATAMID M1276, PLATAMID M1809, PLATAMID M1810, and PLATAMID M1610 (trade names; manufactured by elf atochem Co.) and VESTAMELT X7079 (trade name; manufactured by Daicel-Huls Ltd.) can be used.

Further, as commercially-available copolymerized polyester resins, for example, VESTAMELT 4380 (trade name; manufactured by Daicel-Huls Ltd.) and PLATHERM M1333 (trade name; manufactured by elf atochem) can be used.

In the multilayer insulated wire having a self-bonding layer of the present invention, for making the self-bonding layer, a mixture made by mixing the inorganic filler (D) with the self-bonding resin (C) is preferable, because the damage to the electric wire by high frequencies can be prevented. Particularly, on the outside of the insulating layers in the above-described case of b), it is necessary to use the mixture, in which the inorganic filler (D) is blended, in the self-bonding layer. The inorganic filler (D) is preferably mixed in an amount of 10 to 70 parts by weight, and more preferably 20 to 60 parts by weight, to 100 parts by weight of the self-bonding resin (C). If the amount of the inorganic filler (D) is too small, the effect of improving the high-frequency characteristic cannot be secured, while if the amount of the inorganic filler (D) is too large, the bonding force is lowered in some cases.

The self-bonding layer is formed in such a manner that it fills between the wires. According to the high-frequency test, the damage is caused by scraping of the vicinity of parts where the wires are in close contact with each other. By containing the inorganic filler (D) in these parts, the self-bonding layer is difficult to be scraped off, and therefore the damage by corona under high frequencies can be reduced greatly.

Specific examples and preferable examples of the inorganic filler (D) that can be blended into the self-bonding layer in the present invention are the same as those described for the above inorganic filler (B).

The multilayer insulated wire of the present invention may be provided with a covering layer having a specific function as an outermost layer of the electric wire, on the outside of the above two or more extrusion-coating insulating layers, or on the outside of the above self-bonding layer. For the insulated wire of the present invention, if necessary, a paraffin, a wax (e.g. a fatty acid and a wax), or the like can be used, as a surface-treating agent. The refrigerating machine oil used for enameled windings is poor in lubricity and is liable to make shavings in the coiling operation, but this problem can be solved by applying a paraffin or a wax in a usual manner.

As the conductor for use in the present invention, a metal bare wire (solid wire), an insulated wire having an enamel film or a thin insulating layer coated on a metal bare wire, a multicore stranded wire (a bunch of wires) composed of intertwined metal bare wires, or a multicore stranded wire composed of intertwined insulated-wires that each have an enamel film or a thin insulating layer coated, can be used. The number of the intertwined wires of the multicore stranded wire (a so-called litz wire) can be chosen arbitrarily depending on the desired high-frequency application. Alternatively, when the number of wires of a multicore wire is large, for example, in a 19- or 37-element wire, the multicore wire (elemental wire) may be in a form of a stranded wire or a non-stranded wire. In the non-stranded wire, for example, multiple conductors that each may be a bare wire or an insulated wire to form the elemental wire, may be merely gathered (collected) together to bundle up them in an approximately parallel direction, or the bundle of them may be intertwined in a very large pitch. In each case of these, the cross-section thereof is preferably a circle or an approximate circle. However, it is required that, as the material of the thin insulating layer, a resin that is itself good in solderability, such as a polyurethane resin, an esterimide-modified polyurethane resin, and a urea-modified polyurethane resin, be used, and specifically, for example, WD-4305 (trade name, manufactured by Hitachi Chemical Co., Ltd.), TPU-F1, TSF-200 and TPU-7000 (trade names, manufactured by Totoku Toryo Co., Ltd.) can be used. Further, application of solder to the conductor or plating of the conductor with tin is a means of improving the solderability.

In a preferable embodiment of the present invention, the multilayer insulated wire is made up of three layers of extrusion-coating insulated layers. Preferably, the overall thickness of the three layers is controlled within the range of 60 to 180 $\mu$m. This is because the electrical properties of the resulting heat-resistant multilayer insulated wire are greatly lowered, to make the wire impractical, in some cases, if the overall thickness of the insulating layers is too thin. On the other hand, the solderability is deteriorated considerably in some cases, if the overall thickness of the insulating layers is too thick. More preferably the overall thickness of the extrusion-coating insulating layers is in the range of 70 to 150 μm. Preferably, the thickness of each of the above three layers is controlled within the range of 20 to 60 μm.

Further, in the multilayer insulated wire of the present invention having a self-bonding layer, preferably the thickness of the self-bonding layer is 20 to 60 μm, and more preferably 25 to 40 μm, similarly to the case of the insulating layer in order to secure the bonding force.

The transformer of the present invention, in which the multilayer insulated wire of the present invention is used, not only satisfies the IEC 950 standards, it is also applicable to severe design, since there is no winding of an insulating tape, such that the transformer can be made small in size and the heat resistance and the high-frequency characteristic may be high.

The multilayer insulated wire of the present invention can be used as a winding for any type of transformer, including those shown in FIG. 1. In such a transformer, generally a primary winding and a secondary winding are wound in a layered manner on a core, but the multilayer-insulated wire of the present invention may be applied to a transformer in which a primary winding and a secondary winding are alternatively wound (JP-A-5-152139). Further, in the transformer of the present invention, the above multilayer insulated wire may be used for both the primary winding and the secondary winding, and if the insulated wire having three-layered extruded insulating layers is used for one of the primary and the secondary windings, the other may be an enameled wire. Additionally stated, in the case wherein the insulated wire having two-layered extruded insulating layers is used only for one of the windings and an enameled wire is used for the other, it is required that one layer of an insulating tape is interposed between the windings and an insulating barrier is required to secure a creeping distance.

The multilayer insulated wire of the present invention has such excellent actions and effects that it has high enough heat-resistance to satisfy the heat resistance E class, cracks due to heat shock are not formed, and, further, electric properties at high frequencies are good. Further, since the multilayer insulated wire of the present invention is excellent in solderability and coilability, when the terminal is worked, it can be soldered directly and therefore it can be suitably used as a winding or a lead wire of transformers. Furthermore, in the multilayer insulated wire having a self-bonding layer of the present invention, the scraping-off of the self-bonding layer yielding from the vicinity of parts where wires are in close contact with each other at high frequencies, can be prevented, and therefore the damage to the electric wire by corona under high frequencies can be prevented from occurring. The transformer of the present invention wherein the above multilayer insulated wire is utilized, can meet the requirements for electrical/electronic equipments that are increasingly made to be applied in higher frequencies, because the transformer is excellent in electrical properties without being lowered in electric properties when a high frequency is used in a circuit, and the transformer is prevented from the damage of its wires.

EXAMPLES

The present invention will now be described in more detail with reference to the following examples, but the invention is not limited to them.

Examples 1 to 15, and Comparative Examples 1 to 5

As conductors, bare wires (solid wires) of annealed copper wires of diameter 0.4 mm, and stranded wires, each composed of seven intertwined cores (insulated wires), each made by coating an annealed copper wire of diameter 0.15 mm with Insulating Varnish TPU-F1, trade name, manufactured by Totoku toryo Co., Ltd., so that the coating thickness of the varnish layer would be 6 μm, were provided. The conductors were respectively coated successively, by extrusion coating, with resin layers having the formulations (compositions are shown in terms of parts by weight) for extrusion coating and the thicknesses, shown in Tables 1 to 5, and the resultant coated conductors were respectively surface-treated, thereby preparing multilayer insulated wires.

With respect to the thus-prepared multilayer insulated wires, the properties were measured and evaluated according to the following test methods.

Further, the resins and inorganic fillers used in each example and comparative example, shown in Tables 1 to 5, were as follows.

(Resins (A) and other resins)

PET: polyester resin (polyethylene terephthalate), TR-8550 (trade name, manufactured by Teijin Ltd.)

PCT: polyester resin (polycyclohexanedimethylene terephthalate), EKTAR 676 (trade name, manufactured by Toray Industries, Inc.)

PEN: polyester resin (polyethylene naphthalate), TN-8060 (trade name, manufactured by Teijin Ltd.)

EAA: ethylene/acrylic acid copolymer, EAA (trade name, manufactured by Dow Chemical LTD.)

Ionomer: ethylene/methacrylic acid copolymer (ionomer) HI-MILAN 1855 (trade name, manufactured by Mitsui Polychemical Co., Ltd.)

PUE: polyurethane resin, Miractran E (trade name; manufactured by Nippon Miractran Co., Ltd.)

PA: polyamide resin (nylon 4, 6), F-5001 (trade name, manufactured by Unitika Ltd.)

(Inorganic fillers (B) and (D))

Titanium oxide 1: FR-88 (trade name; manufactured by FURUKAWA CO., LTD.; average particle diameter: 0.19 μm)

Titanium oxide 2: RLX-A (trade name; manufactured by FURUKAWA CO., LTD.; average particle diameter: 3 to 4 μm)

Silica 1: UF-007 (trade name; manufactured by Tatsumori, LTD.; average particle diameter: 5 μm)

Silica 2: 5X (trade name; manufactured by Tatsumori, LTD.; average particle diameter: 1.5 μm)

Silica 3: A-1 (trade name, manufactured by Tatsumori, LTD.; average particle diameter: 10 μm)

(Self-bonding resin (C))

Copolymerized PA1: copolymerized polyamide, VESTAMELT X7079 (trade name; manufactured by Daicel-Huls Ltd.)

Copolymerized PA2: copolymerized polyamide, PLATAMID M1276, (trade name; manufactured by elf atochem Co.)

Copolymerized PE: copolymerized polyester,

PLATHERM M1333 (trade name; manufactured by elf atochem)

(Test methods)

(1) Solderability

A length of about 40 mm at the end of the insulted wire was dipped in molten solder at a temperature of 400° C., and the time (sec) required for the adhesion of the solder to the dipped 30-mm-long part was measured. The shorter the required time is, the more excellent the solderability is. The numerical value shown was the average value of n=3.

(2) Dielectric Breakdown Voltage

The dielectric breakdown voltage was measured in accordance with the two-twisting method of JIS C 3003$^{-1984}$ 11. (2).

(3) Heat Resistance

The heat resistance was evaluated by the following test method, in conformity to Annex U (Insulated wires) of Item 2.9.4.4 and Annex C (Transformers) of Item 1.5.3 of 950-standards of the IEC standards.

Ten turns of the multilayer insulated wire were wound around a mandrel of diameter 6 mm under a load of 118 MPa (12 kg/mm$^2$). They were heated for 1 hour at 215° C., and then for additional 72 hours at 165° C., and then they were kept in an atmosphere of 25° C. and humidity 95% for 48 hours. Immediately thereafter, a voltage of 3,000 V was applied thereto, for 1 min. When there was no electrical short-circuit, it was considered that it passed Class E. (The judgment was made with n=5. It was considered that it did not pass the test if it was NG even when n=1.)

(4) Heat Shock Resistance

The heat shock resistance was evaluated in accordance with IEC 851-6 TEST 9. After winding to the identical diameter (1D) was done, it was placed in a thermostat at 215° C. for 30 min, and then cracks in the coating was observed whether they would formed. When there was no cracks in the coating, it was judged good.

(5) High-Frequency V-t Characteristic

A test specimen was made in accordance with the two-twisting method of JIS C 3003$^{-1984}$ 11. (2), and the life (min) until the occurrence of short-circuit at an applied voltage of 3.5 kV, a frequency of 100 kHz, and a pulse duration of 10 $\mu$s was measured.

(6) Static Friction Coefficients (Coilability)

Figure 3:
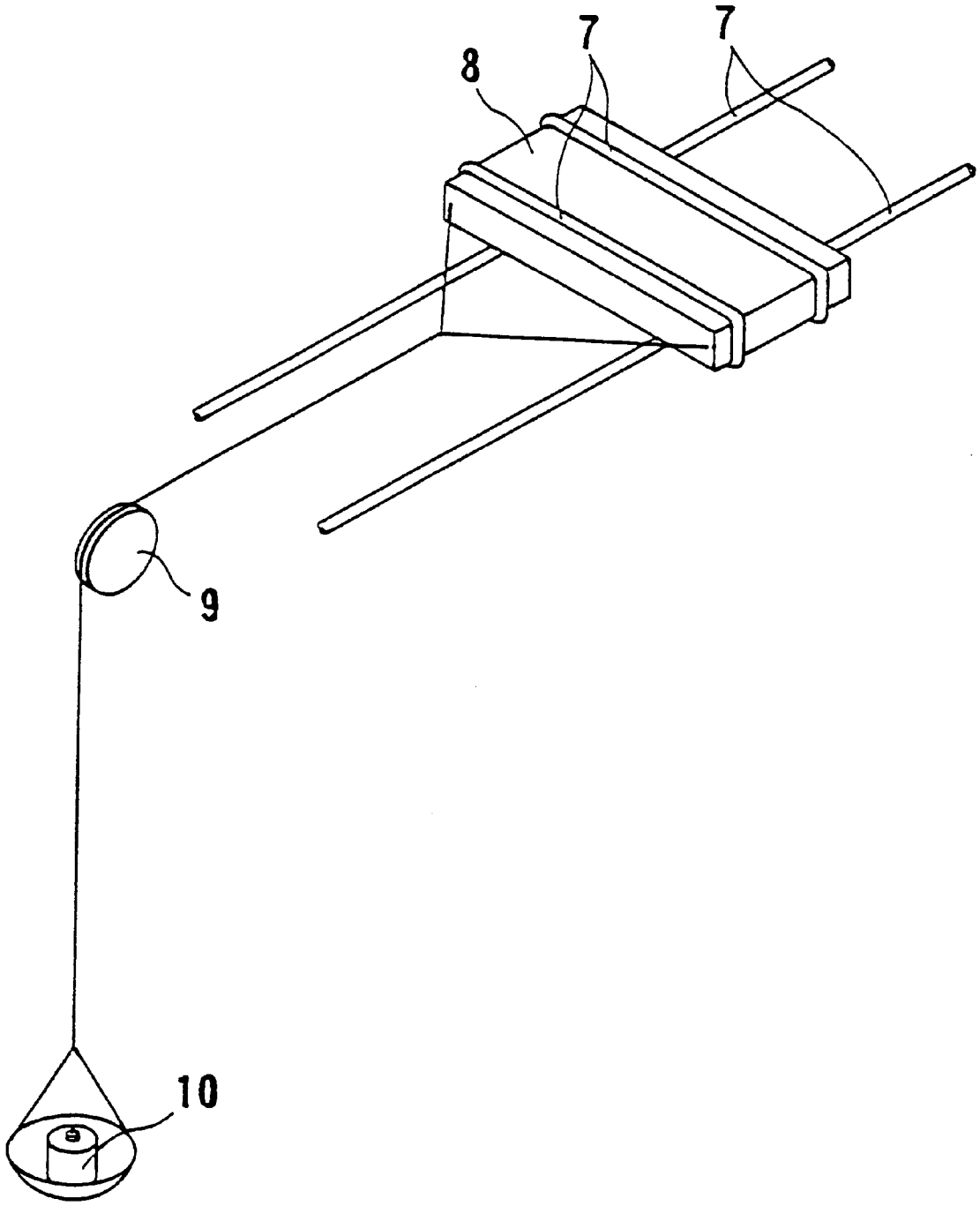
FIG. 3 is a schematic diagram showing a method of measuring static friction coefficients.

The measuring was done with an apparatus shown in FIG. 3. In FIG. 3, 7 indicates multilayer insulated wires, 8 indicates a load plate, 9 indicates a pulley, and 10 indicates a load. Letting the mass of the load 10 be F (g) when the load plate 8 whose mass is W (g) starts to move, the static friction coefficient is found from F/W.

The smaller the obtained numerical value is, the better the slipperiness of the surface is and the better the coilability is.

(7) Water Content

The water content was measured by a Karl Fischer's type water content measuring apparatus. The heating temperature was 200° C. Parenthetically, the materials used in Examples 1 to 15, and Comparative Examples 1 to 4 were dried to have a water content of 0.02% by weight or less. Herein, in Comparative Example 5, use was made of a PET, having the water content of 0.1% by weight, and materials other than the PET, having the water content of 0.02% by weight or less similarly to other Examples and Comparative Examples.

The results are shown in Tables 1, 2, 3, 4, and 5.

TABLE 1

| | | | Example 1 | Example 2 | Example 3 | Example 4 |
|---|---|---|---|---|---|---|
| First layer | Resin (A) | PET | 100 | | | |
| | | PCT | | | | |
| | | PEN | | | | |
| | | EAA | | | | |
| | | Ionomer | 10 | | | |
| | | to 100 wt. parts | 100 | | | |
| | Inorganic filler (B) | titanium oxide 1 | 40 | | | |
| | | titanium oxide 2 | | | | |
| | | silica 1 | | | | |
| | | silica 2 | | | | |
| | Other resin | PET | | | | 100 |
| | | PCT | | 100 | | |
| | | Ionomer | | 30 | | 15 |
| | | PUE | | | | |
| | | PA | | | 100 | |
| | Coating thickness ($\mu$m) | | 33 | 33 | 33 | 33 |
| Second layer | Resin (A) | PET | 100 | | | |
| | | PCT | | 100 | | |
| | | PEN | | | | |
| | | EAA | | | | |
| | | Ionomer | 10 | 30 | | |
| | | to 100 wt. parts | 100 | 100 | | |
| | Inorganic filler (B) | titanium oxide 1 | 40 | | | |
| | | titanium oxide 2 | | 15 | | |
| | | silica 1 | | | | |
| | | silica 2 | | | | |
| | Other resin | PET | | | | 100 |
| | | PCT | | | 100 | |
| | | Ionomer | | | | 15 |
| | | PUE | | | | |
| | | PA | | | 30 | |
| | Coating thickness ($\mu$m) | | 33 | 33 | 33 | 33 |
| Third layer | Resin (A) | PET | 100 | | | 100 |
| | | PCT | | 100 | 100 | |
| | | PEN | | | | |
| | | EAA | | 30 | 30 | |

TABLE 1-continued

| | | | | Example 1 | Example 2 | Example 3 | Example 4 |
|---|---|---|---|---|---|---|---|
| | | Ionomer | | 15 | | | 15 |
| | | to 100 wt. parts | | 100 | 100 | 100 | 100 |
| (outer-most layer) | Inorganic filler (B) | titanium oxide 1 | | 40 | | | 20 |
| | | titanium oxide 2 | | | 15 | | |
| | | silica 1 | | | | 65 | |
| | | silica 2 | | | | | |
| | | silica 3 | | | | | |
| | Other resin | PET | | | | | |
| | | PCT | | | | | |
| | | Ionomer | | | | | |
| | | PUE | | | | | |
| | | PA | | | | | |
| | Coating thickness (μm) | | | 33 | 33 | 33 | 33 |
| Self-bonding tayer (4th layer) | Self-bonding resin (C) | Copolymerized PA1 | | | | | |
| | | Copolymerized PA2 | | | | | |
| | | Copolymerized PE | | | | | |
| | Inorganic filler (D) | titanium oxide 1 | | | | | |
| | | titanium oxide 2 | | | | | |
| | | silica 1 | | | | | |
| | | silica 2 | | | | | |
| | | silica 3 | | | | | |
| | Coating thickness (μm) | | | 0 | 0 | 0 | 0 |
| Overall coating thickness (μm) | | | | 100 | 100 | 100 | 100 |
| Surface-treatment | | | | refrigerating machine oil | solid paraffin | solid paraffin | fatty acid wax |
| Conductor used | | | | 0.4 φ Cu wire | 0.4 φ Cu wire | 0.4 φ Cu wire | 0.4 φ Cu wire |
| Chara-cteri-stic values | Solderability 400° C. | | sec | 3.5 | 3.5 | 3 | 3.5 |
| | Breakdown voltage kV | | av. | 16.4 | 17.9 | 18.8 | 22.5 |
| | Heat resistance | Class E | | passed | passed | passed | passed |
| | Heat shock | ID | | good | good | good | good |
| | Hifh-frequency characteristic | 3.5kV | av. | 142.5‘1 | 53.8 | 17.3 | 16.7 |
| | Static friction coefficient | | av. | 0.16 | 0.09 | 0.11 | 0.1 |

TABLE 2

| | | | Example 5 | Example 6 | Example 7 | Example 8 |
|---|---|---|---|---|---|---|
| First layer | Resin (A) | PET | | 100 | | |
| | | PCT | | | | |
| | | PEN | | | | |
| | | EAA | | | | |
| | | Ionomer | | 5 | | |
| | | to 100 wt. parts | 100 | | | |
| | Inorganic filler (B) | titanium oxide 1 | 40 | | | |
| | | titanium oxide 2 | | | | |
| | | silica 1 | | | | |
| | | silica 2 | | | | |
| | Other resin | PET | 100 | | | |
| | | PCT | | | 100 | |
| | | Ionomer | 15 | | 40 | |
| | | PUE | | | | |
| | | PA | | | | 100 |
| | Coating thickness (μm) | | 60 | 33 | 33 | 33 |
| Second layer | Resin (A) | PET | | 100 | | |
| | | PCT | | | | |
| | | PEN | | | 100 | |
| | | EAA | | | | |
| | | Ionomer | | 5 | 15 | |
| | | to 100 wt. parts | | 100 | 100 | |
| | Inorganic filler (B) | titanium oxide 1 | | 40 | | |
| | | titanium oxide 2 | | | | |
| | | silica 1 | | | | |
| | | silica 2 | | | | |
| | Other resin | PET | 100 | | | |
| | | PCT | | | | 100 |
| | | Ionomer | 15 | | | |
| | | PUE | | | | 15 |
| | | PA | | | | |
| | Coating thickness (μm) | | 60 | 33 | 33 | 33 |
| Third | Resin (A) | PET | 100 | 100 | | |

TABLE 2-continued

| | | | | Example 5 | Example 6 | Example 7 | Example 8 |
|---|---|---|---|---|---|---|---|
| layer | | PCT | | | | | 100 |
| | | PEN | | | | 100 | |
| | | EAA | | | | | 15 |
| | | Ionomer | | 15 | 5 | 15 | |
| | | to 100 wt. parts | | 100 | 100 | 100 | 100 |
| (outer-most layer) | Inorganic filler (B) | titanium oxide 1 | | | 40 | 70 | |
| | | titanium oxide 2 | | | | | 20 |
| | | silica 1 | | | | | |
| | | silica 2 | | 65 | | | |
| | | silica 3 | | | | | |
| | Other resin | PET | | | | | |
| | | PCT | | | | | |
| | | Ionomer | | | | | |
| | | PUE | | | | | |
| | | PA | | | | | |
| | Coating thickness (μm) | | | 60 | 33 | 33 | 33 |
| Self-bonding tayer (4th layer) | Self-bonding resin (C) | Copolymerized PA1 | | | 100 | | |
| | | Copolymerized PA2 | | | | 100 | |
| | | Copolymerized PE | | | | | 100 |
| | Inorganic filler (D) | titanium oxide 1 | | | 40 | | |
| | | titanium oxide 2 | | | | | |
| | | silica 1 | | | | | 20 |
| | | silica 2 | | | | | |
| | | silica 3 | | | | | |
| | Coating thickness (μm) | | | 0 | 30 | 30 | 30 |
| Overall coating thickness (μm) | | | | 180 | 130 | 130 | 130 |
| Surface-treatment | | | | fatty acid wax | fatty acid wax | fatty acid wax | fatty acid wax |
| Conductor used | | | | 0. 4. φ Cu wire | 0.4 φ Cu wire | 0.4 φ Cu wire | 0.4 φ Cu wire |
| Chara-cteri-stic values | Solderability 400° C. | | sec | 5.5 | 4 | 3.5 | 3.5 |
| | Breakdown voltage kV | | av. | 27.4 | 20.1 | 21.3 | 23.6 |
| | Heat resistance | Class E | | passed | passed | passed | passed |
| | Heat shock | ID | | good | good | good | good |
| | Hifh-frequency characteristic | 3.5kV | av. | 68.7 | 270.1 | 20.1 | 93.2 |
| | Static friction coefficient | | av. | 0.1 | 0.12 | 0.12 | 0.11 |

TABLE 3

| | | | Example 9 | Example 10 | Example 11 | Example 12 |
|---|---|---|---|---|---|---|
| First layer | Resin (A) | PET | | | | |
| | | PCT | | | | |
| | | PEN | | | | |
| | | EAA | | | | |
| | | Ionomer | | | | |
| | | to 100 wt. parts | | | | |
| | Inorganic filler (B) | titanium oxide 1 | | | | |
| | | titanium oxide 2 | | | | |
| | | silica 1 | | | | |
| | | silica 2 | | | | |
| | Other resin | PET | | 100 | 100 | 100 |
| | | PCT | 50 | | | |
| | | Ionomer | | 15 | 15 | |
| | | PUE | 50 | | | |
| | | PA | | | | |
| | Coating thickness (μm) | | 33 | 33 | 33 | 33 |
| Second layer | Resin (A) | PET | | | | |
| | | PCT | | | | |
| | | PEN | | | | |
| | | EAA | | | | |
| | | Ionomer | | | | |
| | | to 100 wt. parts | | | | |
| | Inorganic filler (B) | titanium oxide 1 | | | | |
| | | titanium oxide 2 | | | | |
| | | silica 1 | | | | |
| | | silica 2 | | | | |
| | Other resin | PET | 100 | 100 | 100 | 100 |
| | | PCT | | | | |
| | | Ionomer | 15 | 15 | 15 | |
| | | PUE | | | | |
| | | PA | | | | |

TABLE 3-continued

| | | | | Example 9 | Example 10 | Example 11 | Example 12 |
|---|---|---|---|---|---|---|---|
| | Coating thickness (μm) | | | 33 | 33 | 33 | 33 |
| Third layer | Resin (A) | PET | | 100 | | 100 | 100 |
| | | PCT | | | | | |
| | | PEN | | | | 15 | 15 |
| | | EAA | | | | | |
| | | Ionomer | | 30 | | | |
| | | to 100 wt. parts | | 100 | | 100 | 100 |
| (outer-most layer) | Inorganic filler (B) | titanium oxide 1 | | | | | 20 |
| | | titanium oxide 2 | | | | | |
| | | silica 1 | | 40 | | | |
| | | silica 2 | | | | 70 | |
| | | silica 3 | | | | | |
| | Other resin | PET | | | 100 | | |
| | | PCT | | | | | |
| | | Ionomer | | | 15 | | |
| | | PUE | | | | | |
| | | PA | | | | | |
| | Coating thickness (μm) | | | 33 | 33 | 33 | 33 |
| Self-bonding tayer (4th layer) | Self-bonding resin (C) | Copolymerized PA1 | | 100 | 100 | 100 | |
| | | Copolymerized PA2 | | | | | |
| | | Copolymerized PE | | | | | |
| | Inorganic filler (D) | titanium oxide 1 | | | 30 | | |
| | | titanium oxide 2 | | | | | |
| | | silica 1 | | | | | |
| | | silica 2 | | 30 | | 70 | |
| | | silica 3 | | | | | |
| | Coating thickness (μm) | | | 30 | 30 | 30 | 0 |
| Overall coating thickness (μm) | | | | 130 | 130 | 130 | 100 |
| Surface-treatment | | | | fatty acid wax | fatty acid wax | fatty acid wax | fatty acid wax |
| Conductor used | | | | 0.4 ϕ Cu wire | 0.4 ϕ Cu wire | 7-inter-twined wire | 0.4 ϕ Cu wire |
| Chara-cteri-stic values | Solderability 400° C. | | sec | 3.5 | 3.5 | 3.5 | 3 |
| | Breakdown voltage kV | | av. | 23.5 | 25.7 | 29.7 | 22.4 |
| | Heat resistance | Class E | | passed | passed | passed | passed |
| | Heat shock | ID | | good | good | good | good |
| | Hifh-frequency characteristic | 3.5kV | av. | 76.9 | 28.4 | 100.4 | 18.6 |
| | Static friction coefficient | | av. | 0.11 | 0.12 | 0.12 | 0.1 |

TABLE 4

| | | | Example 13 | Example 14 | Example 15 | Comparative Example 1 |
|---|---|---|---|---|---|---|
| First layer | Resin (A) | PET | | | | |
| | | PCT | | | | |
| | | PEN | | | | |
| | | EAA | | | | |
| | | Ionomer | | | | |
| | | to 100 wt. parts | | | | |
| | Inorganic filler (B) | titanium oxide 1 | | | | |
| | | titanium oxide 2 | | | | |
| | | silica 1 | | | | |
| | | silica 2 | | | | |
| | Other resin | PET | 100 | 100 | 100 | 100 |
| | | PCT | | | | |
| | | Ionomer | | | | 15 |
| | | PUE | | | | |
| | | PA | | | | |
| | Coating thickness (μm) | | 33 | 33 | 33 | 33 |
| Second layer | Resin (A) | PET | | | | |
| | | PCT | | | | |
| | | PEN | | | | |
| | | EAA | | | | |
| | | Ionomer | | | | |
| | | to 100 wt. parts | | | | |
| | Inorganic filler (B) | titanium oxide 1 | | | | |
| | | titanium oxide 2 | | | | |
| | | silica 1 | | | | |
| | | silica 2 | | | | |
| | Other resin | PET | 100 | 100 | 100 | 100 |
| | | PCT | | | | |
| | | Ionomer | | | | 15 |

TABLE 4-continued

| | | | | Example 13 | Example 14 | Example 15 | Comparative Example 1 |
|---|---|---|---|---|---|---|---|
| | | PUE | | | | | |
| | | PA | | | | | |
| | Coating thickness (μm) | | | 33 | 33 | 33 | 33 |
| Third layer | Resin (A) | PET | | 100 | 100 | 100 | |
| | | PCT | | | | | |
| | | PEN | | 30 | 15 | 15 | |
| | | EAA | | | | | |
| | | Ionomer | | | | | |
| | | to 100 wt. parts | | 100 | 100 | 100 | |
| (outer-most layer) | Inorganic filler (B) | titanium oxide 1 | | 50 | 20 | 50 | |
| | | titanium oxide 2 | | | | | |
| | | silica 1 | | | | | |
| | | silica 2 | | | | | |
| | | silica 3 | | | | | |
| | Other resin | PET | | | | | |
| | | PCT | | | | | |
| | | Ionomer | | | | | |
| | | PUE | | | | | |
| | | PA | | | | | 100 |
| | Coating thickness (μm) | | | 33 | 33 | 33 | 33 |
| Self-bonding tayer (4th layer) | Self-bonding resin (C) | Copolymerized PA1 | | | 100 | 100 | |
| | | Copolymerized PA2 | | | | | |
| | | Copolymerized PE | | | | | |
| | Inorganic filler (D) | titanium oxide 1 | | | 20 | 50 | |
| | | titanium oxide 2 | | | | | |
| | | silica 1 | | | | | |
| | | silica 2 | | | | | |
| | | silica 3 | | | | | |
| | Coating thickness (μm) | | | 0 | 30 | 30 | 0 |
| Overall coating thickness (μm) | | | | 100 | 130 | 130 | 100 |
| Surface-treatment | | | | fatty acid wax | fatty acid wax | fatty acid wax | refrigerating machine oil |
| Conductor used | | | | 0.4 ϕ Cu wire | 0.4 ϕ Cu wire | 0.4 ϕ Cu wire | 0.4 ϕ Cu wire |
| Characteristic values | Solderability 400° C. | | sec | 3 | 3.5 | 3.5 | 3 |
| | Breakdown voltage kV | | av. | 22.0 | 23.6 | 23.9 | 21.5 |
| | Heat resistance | Class E | | passed | passed | passed | passed |
| | Heat shock | ID | | good | good | good | good |
| | Hifh-frequency characteristic | 3.5kV | av. | 19.9 | 26.4 | 30 | 1.5 |
| | Static friction coefficient | | av. | 0.1 | 0.11 | 0.11 | 0.09 |

TABLE 5

| | | | Comparative Example 2 | Comparative Example 3 | Comparative Example 4 | Comparative Example 5* |
|---|---|---|---|---|---|---|
| First layer | Resin (A) | PET | | | | |
| | | PCT | | | | |
| | | PEN | | | | |
| | | EAA | | | | |
| | | Ionomer | | | | |
| | | to 100 wt. parts | | | | |
| | Inorganic filler (B) | titanium oxide 1 | | | | |
| | | titanium oxide 2 | | | | |
| | | silica 1 | | | | |
| | | silica 2 | | | | |
| | Other resin | PET | 100 | 100 | 100 | 100 |
| | | PCT | | | | |
| | | Ionomer | 15 | 15 | 60 | 15 |
| | | PUE | | | | |
| | | PA | | | | |
| | Coating thickness (μm) | | 33 | 33 | 33 | 33 |
| Second layer | Resin (A) | PET | | | | |
| | | PCT | | | | |
| | | PEN | | | | |
| | | EAA | | | | |
| | | Ionomer | | | | |
| | | to 100 wt. parts | | | | |
| | Inorganic filler (B) | titanium oxide 1 | | | | |
| | | titanium oxide 2 | | | | |

TABLE 5-continued

| | | | | Comparative Example 2 | Comparative Example 3 | Comparative Example 4 | Comparative Example 5* |
|---|---|---|---|---|---|---|---|
| | | silica 1 | | | | | |
| | | silica 2 | | | | | |
| | Other resin | PET | | 100 | 100 | 100 | 100 |
| | | PCT | | | | | |
| | | Ionomer | | 15 | 15 | 60 | 15 |
| | | PUE | | | | | |
| | | PA | | | | | |
| | Coating thickness (μm) | | | 33 | 33 | 33 | 33 |
| Third layer | Resin (A) | PET | | 100 | 100 | | 100 |
| | | PCT | | | | | |
| | | PEN | | | 15 | | |
| | | EAA | | | | | |
| | | Ionomer | | | | | 15 |
| | | to 100 wt. parts | | 100 | 100 | | 100 |
| (outer-most layer) | Inorganic filler (B) | titanium oxide 1 | | 120 | | | 20 |
| | | titanium oxide 2 | | | | | |
| | | silica 1 | | | | | |
| | | silica 2 | | | | | |
| | | silica 3 | | | 90 | | |
| | Other resin | PET | | | | 100 | |
| | | PCT | | | | | |
| | | Ionomer | | | | 60 | |
| | | PUE | | | | | |
| | | PA | | | | | |
| | Coating thickness (μm) | | | 33 | 33 | 33 | 33 |
| Self-bonding tayer (4th layer) | Self-bonding resin (C) | Copolymerized PA1 | | | | | |
| | | Copolymerized PA2 | | | | 100 | |
| | | Copolymerized PE | | | | | |
| | Inorganic filler (D) | titanium oxide 1 | | | | 40 | |
| | | titanium oxide 2 | | | | | |
| | | silica 1 | | | | | |
| | | silica 2 | | | | | |
| | | silica 3 | | | | | |
| | Coating thickness (μm) | | | 0 | 0 | 30 | 0 |
| Overall coating thickness (μm) | | | | 100 | 100 | 130 | 100 |
| Surface-treatment | | | | refrigerating machine oil | fatty acid wax | fatty acid wax | fatty acid wax |
| Conductor used | | | | 0.4 ϕ Cu wire | 0.4 ϕ Cu wire | 0.4 ϕ Cu wire | 0.4 ϕ Cu wire |
| Characteristic values | Solderability 400° C. | | sec | 3.5 | 3.5 | 7 | 3.5 |
| | Breakdown voltage kV | | av. | 15.4 | 12.1 | 21 | 19.6 |
| | Heat resistance | Class E | | not passed | not passed | not passed | not passed |
| | Heat shock | ID | | poor | poor | good | poor |
| | Hifh-frequency characteristic | 3.5kV | av. | 13.7 | 10.8 | 23.9 | 15.2 |
| | Static friction coefficient | | av. | 0.21 | 0.15 | 0.15 | 0.10 |

Note)
*Only the PET used in Comparative Example 5 had the water content of 0.1% by weight.

All of the insulated wires of Examples 1 to 15 passed the test of the heat resistance E class, and they have good solderability and heat shock resistance and excellent high-frequency characteristics. Further, with respect to the wires which were subjected to a surface treatment with a solid paraffin or a fatty acid wax, particularly the coefficient of static friction was low and the coilability was good.

In Example 1, since all of the three layers were made of a mixture containing the inorganic filler (B) as specified in the present invention, the properties including the heat resistance were good and particularly the high-frequency characteristic was good, although it was noticed that the dielectric breakdown voltage was lowered a little.

In Example 2, a mixture containing the inorganic filler (B) was used in two layers including the outermost layer, and the properties were good and well balanced.

In Examples 3 and 4, a mixture containing the inorganic filler (B) was used only in the outermost layer, and although the properties were good and well balanced, the high-frequency characteristic was rather low in comparison with those of Examples 1 and 2.

In Example 5, the coating thickness was thicker than that of Examples 3 and 4, and the electrical properties were good, although the solderability was lower than that of Examples 3 and 4.

Example 6 was a case of the multilayer insulated wire wherein all of the three insulating layers were made of a mixture containing the inorganic filler (B) as specified in the present invention, and wherein a self-bonding layer made of a mixture containing the inorganic filler (D) was formed thereon, the properties were good and particularly the high-frequency characteristic was excellent.

In Example 7, a mixture containing the inorganic filler (B) was used for the insulating layer that was the third layer, and a self-bonding layer free from any inorganic filler was formed thereon.

Examples 8 and 9 each were a case of the multilayer insulated wire, wherein the insulating layer that was the third layer was made of the mixture containing the inorganic filler (B), and wherein, on the insulating layers, a self-bonding layer was made of a mixture containing the inorganic filler (D), the properties were good and well balanced.

Example 10 was a case of the multilayer insulated wire wherein a self-bonding layer made of a mixture containing the inorganic filler (D) was formed on the three insulating layers made only of a thermoplastic polyester-series resin blended with an ethylene-series copolymer. It can be understood that even if the inorganic filler was used only in the self-bonding layer, the high-frequency characteristic was improved greatly.

In Example 11, since seven-coating intertwined wire was used as a conductor, the properties including the high-frequency characteristic were particularly good.

Examples 12 and 13 each were the case of the multilayer insulated wire, wherein the first and second layers each were made only of a thermoplastic polyester-series resin and the third layer was made of the mixture in which the thermoplastic polyester-series resin (A) and the inorganic filler (B) were blended. These Examples 12 and 13 showed properties almost the same to those in Examples 3 and 4.

Examples 14 and 15 each were the case of the multilayer insulated wire, wherein a self-bonding layer was made of the mixture containing the inorganic filler (D) onto the insulating structure similar to Examples 12 and 13, and high-frequency characteristic was further improved in Examples 14 and 15.

On the other hand, Comparative Example 1 was a case of the multilayer insulated wire having no insulating layer containing the inorganic filler (B), and although the evaluation of the heat resistance was on the level of passing the E class, the high-frequency characteristic was conspicuously low, in comparison with those of Examples 1 to 15.

In Comparative Example 2, since the amount of the inorganic filler (B) was 120 parts by weight, which was too large, the flexibility in the ordinary state was lowered greatly, and as a result the heat resistance, the breakdown voltage, and the heat shock resistance were poor, and the high-frequency characteristic was low.

In Comparative Example 3, since the amount of the inorganic filler (B) was too large and its particle diameter was 10 $\mu$m that was too large, the external appearance of the wire was bad, and the properties were low in general.

In Comparative Example 4, since the ethylene-series copolymer was blended too much, the heat resistance and coilability were noticed to be poor.

In Comparative Example 5, a multilayer insulated wire was produced in the same manner as in Example 4, except that, as the thermoplastic polyester-series resin, a PET having a water content of 0.1% by weight was used and that the water content of each of other materials was controlled to 0.02% by weight, thereby carrying out mixing. Accordingly, in comparison with other Examples and Comparative Examples wherein the weight average molecular weight of the thermoplastic polyester-series resin (A) was 30,000 or more, the weight average molecular weight of the PET resin in Comparative Example 5 was as low as 17,000. Because of the lowering of the molecular weight of the PET resin, the flexibility of the resultant electric wire in Comparative Example 5 was poor, and both the heat resistance and the heat shock resistance which were tested and evaluated after winding of the electric wire were poor.

INDUSTRIAL APPLICABILITY

The multilayer insulated wire of the present invention is favorably suitable for use in high-frequency equipment, such as computers, parts of domestic electric equipment, and communication equipment, since it is heat-resistant high enough to satisfy the heat resistance E class, cracks due to heat shock are not formed, and, further, electric properties at high frequencies are good. Further, since the multilayer insulated wire of the present invention has excellent solderability and coilability, when the terminal is worked, it can be soldered directly and therefore it is favorably suitable for a winding or a lead wire of transformers. Furthermore, in the multilayer insulated wire having a self-bonding layer of the present invention, the scraping-off of the self-bonding layer yielding from parts where wires are in close contact with each other at high frequencies, can be prevented, and therefore the damage to the electric wire by corona under high frequencies can be prevented. Accordingly, such a multilayer insulated wire having a self-bonding layer is favorably suitable for use in high-frequency equipment, such as computers, parts of domestic electric equipment, and communication equipments.

Further, the transformer of the present invention wherein the multilayer insulated wire is utilized, is favorably suitable for electrical/electronic equipments that are increasingly made to be applied in higher frequencies, because the transformer has excellent electrical properties without having lower electrical properties when a high frequency is used in a circuit, and the transformer is prevented from the damage of its wires.

Having described our invention as related to the present embodiments, it is our intention that the invention not be limited by any of the details of the description, unless otherwise specified, but rather be construed broadly within its spirit and scope as set out in the accompanying claims.

What is claimed is:

1. A multilayer insulated wire comprising a conductor and solderable extrusion-insulating layers made up of two or more layers for covering the conductor, wherein at least one of said insulating layers including the outermost layer is made of a mixture comprising 100 parts by weight of resin components, said mixture in which 100 parts by weight of a thermoplastic polyester-series resin (A) is blended with 5 to 40 parts by weight of an ethylene-series copolymer having a carboxylic acid component or a metal salt of the carboxylic acid component in its side chain, and 10 to 80 parts by weight of at least one inorganic filler (B) selected from the group consisting of titanium oxide, silica, alumina, zirconium oxide, barium sulfate, clay, and talc, the multilayer insulated wire being formed by a method comprising forming the at least one of said layers including the outermost layer by extrusion-coating of the mixture made by mixing the thermoplastic polyester-series resin (A), the ethylene-series copolymer having a carboxylic acid component or the metal salt of the carboxylic acid component on its side chain, and the inorganic filler (B), wherein the thermoplastic polyester-series resin (A), the ethylene-series copolymer, and the inorganic filler (B) are kneaded into a mixture after the water content of each of the thermoplastic polyester-series resin (A), the ethylene-series copolymer, and the inorganic filler (B) is brought to 0.02% by weight or less, and the resulting mixture is extruded onto the outside of the conductor to form the at least one insulating layer with the water content of the resulting mixture being 0.02% by weight or less.

2. The multilayer insulated wire as claimed in claim 1, wherein the remaining layers other than the at least one insulating layer including the outermost layer each are made of the thermoplastic polyester-series resin (A) or a mixture in which 100 parts by weight of the resin is blended with 5 to 40 parts by weight of the ethylene-series copolymer having a carboxylic acid component or a metal salt of the carboxylic acid component in its side chain.

3. The multilayer insulated wire as claimed in claim 1, wherein the at least one insulating layer including the outermost layer is made of the mixture in which 20 to 60 parts by weight of the inorganic filler (B) is blended.

4. The multilayer insulated wire as claimed in claim 1, wherein the thermoplastic polyester-series resin (A) comprises at least one selected from the group consisting of polyethylene terephthalate resins, polybutylene naphthalate resins, polycyclohexanedimethylene terephthalate resins, and polyethylene naphthalate resins.

5. The multilayer insulated wire as claimed in claim 1, wherein the inorganic filler (B) comprises at least one selected from among titanium oxide and silica.

6. The multilayer insulated wire as claimed in claim 1, wherein the inorganic filler (B) has an average particle diameter of 5 $\mu$m or less.

7. The multilayer insulated wire as claimed in claim 1, wherein a self-bonding resin (C) is extruded onto the outside of the insulating layers, to form a self-bonding layer.

8. The multilayer insulated wire as claimed in claim 7, wherein the self-bonding resin (C) is a copolymerized polyester resin or a copolymerized polyamide resin.

9. The multilayer insulated wire as claimed in claim 7, wherein the self-bonding layer is one formed by extruding a mixture made by mixing 100 parts by weight of the self-bonding resin (C) with 10 to 70 parts by weight of at least one inorganic filler (D) selected from the group consisting of titanium oxide, silica, alumina, zirconium oxide, barium sulfate, clay, and talc.

10. A transformer, wherein the multilayer insulated wire in claim 1 is utilized.

11. A multilayer insulated wire comprising a conductor and solderable extrusion-insulating layers made up of two or more layers for covering the conductor, wherein at least one of said insulating layers including the outermost layer is made of a mixture in which 100 parts by weight of a thermoplastic polyester-series resin (A) is blended with 5 to 40 parts by weight of an ethylene-series copolymer having a carboxylic acid component or a metal salt of the carboxylic acid component in its side chain, and a resin made by mixing 100 parts by weight of a self-bonding resin (C) with 10 to 70 parts by weight of at least one inorganic filler (D) selected from the group consisting of titanium oxide, silica, alumina, zirconium oxide, barium sulfate, clay, and talc, is extruded onto the outside of the insulating layers, to form a self-bonding layer, the multilayer insulated wire being formed by a method comprising forming the at least one of said layers including the outermost layer by extrusion-coating of the mixture made by mixing the thermoplastic polyester-series resin (A), the ethylene-series copolymer having a carboxylic acid component or the metal salt of the carboxylic acid component on its side chain, and the inorganic filler (B), wherein the thermoplastic polyester-series resin (A), the ethylene-series copolymer, and the inorganic filler (B) are kneaded into a mixture after the water content of each of the thermoplastic polyester-series resin (A), the ethylene-series copolymer, and the inorganic filler (B) is brought to 0.02% by weight or less, and the resulting mixture is extruded onto the outside of the conductor to form the insulating layer with the water content of the resulting mixture being 0.02% by weight or less.

12. The multilayer insulated wire as claimed in claim 11, wherein the thermoplastic polyester-series resin (A) comprises at least one selected from the group consisting of polyethylene terephthalate resins, polybutylene naphthalate resins, polycyclohexanedimethylene terephthalate resins, and polyethylene naphthalate resins.

13. The multilayer insulated wire as claimed in claim 11, wherein the self-bonding resin (C) is a copolymerized polyester resin or a copolymerized polyamide resin.

14. The multilayer insulated wire as claimed in claim 11, wherein the inorganic filler (D) comprises at least one selected from among titanium oxide and silica.

15. The multilayer insulated wire as claimed in claims 11, wherein the inorganic filler (D) has an average particle diameter of 5 $\mu$m or less.

16. A method of producing a multilayer insulated wire, the wire comprising a conductor and solderable extrusion-insulating layers made up of two or more layers for covering the conductor, wherein at least one of said insulating layers including the outermost layer is made of a mixture in which 100 parts by weight of a thermoplastic polyester-series resin (A) is blended with 5 to 40 parts by weight of an ethylene-series copolymer having a carboxylic acid component or a metal salt of the carboxylic acid component in its side chain, and 10 to 80 parts by weight of at least one inorganic filler (B) selected from the group consisting of titanium oxide, silica, alumina, zirconium oxide, barium sulfate, clay, and talc;

said method comprising forming the at least one of said layers including the outermost layer by extrusion-coating of the mixture made by mixing the thermoplastic polyester-series resin (A), the ethylene-series copolymer having a carboxylic acid component or a metal salt of the carboxylic acid component on its side chain, and the at least one inorganic filler (B), wherein the thermoplastic polyester-series resin (A), the ethylene-series copolymer, and the inorganic filler (B) are kneaded into a mixture after the water content of each of the thermoplastic polyester-series resin (A), the ethylene-series copolymer, and the inorganic filler (B) is brought to 0.02% by weight or less, and the resulting mixture is extruded onto the outside of the conductor to form the at least one insulating layer with the water content of the resulting mixture being 0.02% by weight or less.

* * * * *